US005707579A

United States Patent [19]

Habelski et al.

[11] Patent Number: 5,707,579

[45] Date of Patent: Jan. 13, 1998

[54] PROCESS FOR PRODUCING FOAMED MATERIAL FROM WASTE PAPER AND THE LIKE

[75] Inventors: Norbert Habelski, Merseburg; Edgar Brandauer, Halle, both of Germany

[73] Assignee: Schweitzer, Vodermair & Schimmer-Wottrich GBR, Vaterstetten, Germany

[21] Appl. No.: 729,984

[22] Filed: Oct. 11, 1996

Related U.S. Application Data

[63] Continuation-in-part of Ser. No. 386,685, Feb. 10, 1995, abandoned.

[30] Foreign Application Priority Data

Feb. 11, 1994 [DE] Germany ..... 44 04 322.8

[51] Int. Cl.[6] ..... B29C 44/02; B29C 44/20

[52] U.S. Cl. ..... 264/417; 264/37; 264/48; 264/53; 264/162; 264/232; 264/DIG. 69; 521/84.1

[58] Field of Search ..... 264/109, 53, 25, 264/26, 37, DIG. 69, 48, 417, 162, 232; 521/84.1

[56] References Cited

U.S. PATENT DOCUMENTS

| | | | |
|---|---|---|---|
| 4,102,963 | 7/1978 | Wood | 264/91 |
| 4,123,489 | 10/1978 | Kelley | 264/141 |
| 4,242,220 | 12/1980 | Sato | 264/26 |
| 4,772,430 | 9/1988 | Sauda et al. | 264/25 |
| 4,810,445 | 3/1989 | Lamb, Sr. et al. | 264/112 |
| 4,894,192 | 1/1990 | Warych | 264/68 |
| 5,185,382 | 2/1993 | Neumann et al. | 521/84.1 |
| 5,186,990 | 2/1993 | Starcevich | 521/84.1 |
| 5,344,595 | 9/1994 | Aoki et al. | 264/26 |
| 5,360,825 | 11/1994 | Noguchi et al. | 521/84.1 |
| 5,362,776 | 11/1994 | Barenberg et al. | 524/35 |
| 5,607,983 | 3/1997 | Chi et al. | 521/84.1 |

FOREIGN PATENT DOCUMENTS

| | | |
|---|---|---|
| 671504 | 9/1995 | European Pat. Off. . |
| 873763 | 7/1942 | France . |
| 3114527 | 10/1982 | Germany . |
| 3307736 | 9/1984 | Germany . |
| 3420195 | 12/1985 | Germany . |
| 3444264 | 6/1986 | Germany . |
| 3510214 | 9/1986 | Germany . |
| 3522395 | 11/1986 | Germany . |
| 3624164 | 1/1988 | Germany . |
| 3641464 | 8/1988 | Germany . |
| 3704309 | 8/1988 | Germany . |
| 3718545 | 12/1988 | Germany . |
| 3900289 | 7/1990 | Germany . |
| 4025694 | 10/1991 | Germany . |
| 9200066 | 4/1992 | Germany . |
| 4105245 | 10/1992 | Germany . |
| 4135069 | 4/1993 | Germany . |
| 9216620 | 5/1993 | Germany . |
| 9303498.9 | 6/1993 | Germany . |
| 4207233 | 11/1993 | Germany . |

*Primary Examiner*—Allan R. Kuhns
*Attorney, Agent, or Firm*—Collard & Roe, P.C.

[57] ABSTRACT

A process for the production of foamed material from waste paper and the like, such as paper, cardboard, waste cardboard or materials with similar properties, are usable in the same way as raw material, either sorted by type of material or as a raw material mixture. First, a liquid-containing pulp is prepared from the raw materials. The foaming and hardening of this pulp takes place under the action of microwave radiation. By using suitable molds permitting an unobstructed access of the radiation to the liquid-containing mass and unhindered expulsion of the resulting vapor, it is possible to manufacture any type of shaped bodies in a continuous or batch-wise process.

11 Claims, No Drawings

PROCESS FOR PRODUCING FOAMED MATERIAL FROM WASTE PAPER AND THE LIKE

CROSS-REFERENCE TO RELATED APPLICATION

This is a Continuation-In-Part Patent Application of parent U.S. patent application Ser. No. 08/386,685 filed Feb. 10, 1995, now abandoned.

BACKGROUND OF THE INVENTION

1. Field of the Invention

The present invention relates to a process for producing foamed material from waste paper and similar materials. Paper, cardboard, waste cardboard or materials with similar properties are usable as raw materials in the same way, either sorted according to type or as a raw material mixture. The invention is intended to preferably make a contribution to environmental protection by the recovery and treatment of secondary raw materials that are available in substantial quantities.

It is possible by the process according to the invention to produce different final products, in particular construction elements for thermal insulation and for sound damping, as well as elements for vibration absorption and shock absorption. Other final products include roof covering panels or wall lining panels, composite boards, and other shaped bodies for use as filler material for insulation and packing purposes. Special treatments to the final product are possible by adding, for example, hydrophobic agents, fireproofing agents, rot-inhibiting agents or reaction aids.

The above enumerations are to be understood as given by way of example.

2. The Prior Art

In the state of the art it is known that several processes for the manufacture of such products already exist. Furthermore, suitable devices for carrying out such processes for and producing the final product itself can be found in the documented state of the art. With respect to the state of the art, reference is made to the following listed documents:

DE 31 14 527; DE 33 07 736; DE 34 20 195; DE 34 44 264; DE 35 10 214; DE 35 22 395; DE 36 24 164; DE 36 41 464; DE 37 04 309; DE 37 18 545; DE 39 00 289; DE 40 25 694; DE 41 35 069; DE 92 00 066; DE 92 16 620; DE 93 03 498.

An important known process step is the preparation of a liquid or aqueous pulp from these raw materials, which is referred to below as the "paper pulp", including the steps of cutting up and mixing of the components.

These preparatory measures are not the subject matter of the invention, but are only made use of. Of special importance is the heat treatment of the paper pulp made available.

The known technical solutions for the heat treatment of the paper pulp are, without exception, based on conventional processes, devices or installations.

The term "conventional" is understood to mean the following:

- the expansion of the mass is achieved through the introduction of heat at temperatures from 120° C. to 140° C.;
- the heat treatment at temperatures above 200° C. with water vapor saturation in an autoclave;
- the thermal and mechanical introduction of energy in the extruder; upon exiting from the extruder, the mass foams up due to the drop in temperature and pressure;

- heating under pressure application in general; and
- treatment with hot air and steam.

All of these processes are characterized by high energy requirement, which often is associated with considerable financial expenditure in terms of equipment, which in turn results from the large number of process steps. These processes predominantly work discontinuously because the large amounts of energy required cannot be introduced within the shortest possible time. The evaporation of liquid is characterized by a certain time delay and inertia. For this reason, the prior art efficiency is adequate only for a limited number of applications.

Another prior art procedure is that described in the Aoki U.S. Pat. No. 5,344,595, which requires the presence of an adhesive within the waste paper or pulp and in the final product.

Special treatments, if any, are, like the preparation of the paper pulp, not the subject matter of the process according to the invention. In this regard, tested means and methods are used.

SUMMARY OF THE INVENTION

It is an object of the present invention to reduce the time required to carry out the known processes, which is a precondition for permitting the process to be carried out continuously, and for permitting a reduction in the financial expenditure for equipment and for a reduction in any heat losses.

According to the present invention, the above object is achieved as follows:

It is known that a paper pulp mixed with liquid foams up during treatment with thermal energy, when the liquid starts to evaporate. The foaming effect can be increased by further additions of thermal energy.

This process is based on the fact that the change of state of a liquid into the gaseous phase is associated with a considerable increase in volume. The vapor flowing off from the paper pulp creates the number of flow paths that are required to enable the vapor to escape. The solidification of the paper pulp begins upon the withdrawal of the liquid therefrom and permits the flow paths to remain preserved as hollow spaces.

The solution of the prior art problems according to the present invention starts at this point.

According to the invention, the paper pulp is subjected to microwave radiation instead of being subjected to the conventional heat treatment, with such microwave radiation preferably being in the range of 915 MHz and 2.45 GHz.

The advantages of this method for introducing energy are based on the fact that with microwaves, as opposed to heat radiation, it is possible to realize very high energy densities. In addition, the energy acts on the paper pulp not merely at the surface, but also penetrates into the paper pulp and directly heats the liquid, causing the latter to evaporate. With a suitable high energy density, the heat treatment takes place with such violence that the resulting vapor, by creating paths for its expulsion from the volume of the paper pulp exposed to this penetrating radiation, leads to an expansion of the paper pulp mass, which creates porosity within the mass.

Since this process, due to the evaporation of the liquid, is simultaneously a drying process, a solidification of the material starts as the volume of the paper pulp increases, with such solidification stabilizing the hollow spaces and porosity created in the paper pulp. The process can be supplemented by adding foaming agents and stabilizing agents.

The process of the invention is based upon the following physical characteristics, the technical implementation of which is the subject matter of the invention.

Microwave radiation is capable of penetrating through materials with a suitable dielectric constant, for example such as glass or paper, without loss of energy. Other materials absorb microwave radiation, i.e., such materials consume the energy of the microwaves. This process is also referred to as coupling to the microwaves. This takes place in the molecular range and is manifest by a heating of the material activated by the microwaves. Such material includes, for example, water in the liquid state. Accordingly, in a water-containing paper pulp, the energy made available by the microwaves is directly and only transmitted to the water molecules. The heat is generated in the volume subjected to the penetrating through radiation. Thus in the interior of the body, heat is dissipated, and does not have to be transmitted from the outside to the inside as with a heat transfer using a temperature difference as the propelling force. For this reason, a body is uniformly heated under microwave radiation throughout the entire volume irradiated. Due to heat losses at the surface of the body, the volume-specific amount of heat stored can be even greater in the interior of the body than near its surface. With suitable energy density leading to evaporation of the water, an excess pressure is generated in the interior of the through-irradiated body volume, such excess pressure leading to expulsion of the water vapor in the direction of the surface of the body.

If the irradiated body is dimensionally unstable, as it is in the case of the paper pulp considered here, flow paths are created in the body in the form of hollow spaces by the steam being expelled. The body takes on a porous structure and breaks up considerably. Its volume increases. Since a hardening process starts in this stage at the same time due to drying of the material, such a voluminous and porous structure remains preserved.

This means a substantial simplification of the after-treatment in terms of process engineering. If necessary, after-treatment process steps may be utilized.

A technical procedure for the implementation of this process for the manufacture of foamed material, particularly of shaped bodies, depends on the desired result of the production, and it can be carried out both batch-wise (discontinuously) and continuously. This depends upon the shape of the mold.

In terms of equipment, it is necessary to make sure that a largely unobstructed irradiation with microwaves is possible, taking into account the increase in volume of the paper pulp, and that the water vapor can be expelled from the mold unhindered at the same time.

It is acknowledged that a water component is contained in the starting mixture both in the Aoki U.S. Pat. No. 5,344,595 and in the present invention. If this were not the case, neither one of the two processes would be operable. The difference lies in the fact that Aoki must use a combination of an adhesive plus water in an amount making the use of a scoop mold absolutely necessary, and that the starting mixture has to be dehydrated in a first process step. For this reason, provision is made for suitable dewatering openings in the mold. With the present invention, neither a scoop mold is required nor are dewatering measures required because the starting mixture used contains maximally the amount of water which the paper fibers are capable of absorbing for swelling and expansion. Minimally, water is contained in an amount permitting the invention to achieve its intended results, i.e., permitting the microwave radiation to develop its expansion effect. No adhesive is required to produce a solid product with the present invention.

The present invention exclusively uses the microwave radiation for significantly increasing the volume of the starting mixture. The process of volume enlargement is not obstructed in any notable way. The "mold", therefore, is not any scoop mold in the terms of Aoki. It has to be suitable only for receiving the starting mixture. This requirement could be satisfied, for example, by a sheet metal panel or an endless conveyor belt.

The amount of water in the raw material starting mixture of paper pulp ranges between a minimum of 5% by weight and a maximum of 75% by weight, preferably from 10% to 65% by weight, and most preferably from 15% to 50% by weight. These weight ranges are based upon the total weight of the raw material starting mixture before the microwave heating thereof. The use of this weight range eliminates the need to use an adhesive as is required by Aoki.

The increase in volume of the starting mixture due to the microwave radiation is accompanied by the solidification without the need for any adhesive according to the present invention. The physical process taking place is explained above in detail. For its realization, the present invention uses microwave radiation devoid of adhesive. An additive of adhesive is required with Aoki. Aoki has not recognized the physical connections explained in the present specification, where adhesive is not used.

No drying in the sense of evaporation of excess water is required in connection with the present invention, where it is necessary only for the functioning of the process to make sure that the liquid water contained in the interior of the body of paper fibers changes to the steam phase, thus building up an inside pressure, and expanding the body in this way. The microwave radiation can be stopped once the desired increase in volume has been reached, since no adhesive is present in the present invention. Aoki, on the other hand, has to implement extensive drying measures in order to eliminate the excess water, which continues to be present in spite of dehydration, so that the Aoki adhesive can be effective.

Generally speaking, the present invention provides a process for producing foamed material from old paper and the like, whereby a starting mixture mixed with liquid, preferably water, is prepared from the specified raw materials in preparatory process steps, which starting mixture may be provided with additives devoid of adhesive for obtaining the desired properties in the final product, comprising the starting mixture minimally contains as much water as is required for developing the expansion effect of the radiation; however, the starting mixture maximally contains only as much water as the cellulose-containing fibers of the materials used are capable of absorbing; and that the starting mixture is subsequently foamed and expanded by the irradiation with microwave radiation and is solidified at the same time.

In another embodiment, the starting mixture contains exactly as much water as is required for increasing the volume by an exactly defined percentage amount.

In a further embodiment, the starting mixture for carrying out a continuous process is uniformly loaded in the required amount with a defined layer thickness onto an endless transport means with suitable side walls or delimitations, and continuously irradiating the starting mixture with microwave radiation of a magnetron, whereby the increase in volume of the final product takes place into the free space above and between the side walls.

In another embodiment, the starting mixture for carrying out a continuous process is uniformly loaded in the required amount with a defined layer thickness onto a support with suitable side walls or delimitations, subsequently irradiating the starting mixture with microwave radiation, and removing it again upon termination of the duration of radiation, whereby the increase in volume takes place into the free space above and between the side walls.

In a further embodiment, the water vapor formed due to the introduction of heat is removed from the treatment zone, and is subjected to a condensing process to form liquid water, and is recycled to be used again for the preparation of the paper pulp.

In another embodiment, the foaming step simultaneously occurs with a solidifying step and thus the shaping process, is not carried out until after the water has been completely removed. Thus the foamed material is subjected to one or a plurality of after-treatment stages, which preferably include the steps of after-hardening, residual drying, surface treatment, or finishing.

In a further embodiment, the heat generated in the magnetrons during the energy conversion, and the heat liberated in the process of steam condensation is used for after-treatment process steps which consume thermal energy.

In another embodiment, the frequency of the microwave radiation is in the range of 915 MHz and 2.45 GHz.

In a further embodiment, foamed material is produced in the form of panels with a defined thickness.

Further treatment steps can be used in the process for producing a foamed material product according to the invention. For example, there can be a vacuuming off of the vapor of the liquid generated due to the introduction of microwave radiation. This is followed by condensing the vapor back to a liquid; and then recycling and reusing the liquid again for the treatment of the paper pulp.

While several embodiments of the present invention have been shown and described, it is to be understood that many changes and modifications may be made thereunto without departing from the spirit and scope of the invention as defined in the appended claims.

What is claimed is:

1. Process for producing foamed and solidified material from recycled paper comprising:

preparing a starting mixture by mixing paper with a liquid, comprising water devoid of adhesive;

optionally providing said starting mixture with additives devoid of adhesive for obtaining desired properties in a final product;

said starting mixture minimally containing as much water as is required for causing foaming and solidifying due to microwave radiation;

said starting mixture maximally containing only as much water as cellulose containing fibers of the materials used are capable of absorbing;

applying microwave radiation to said starting mixture causing foaming of said starting mixture and carrying out the foaming and simultaneously the solidifying and the shaping of the starting mixture after the water has been completely removed; and subjecting the foamed material to at least one after-treatment step selected from the group consisting of after-hardening, residual drying, surface treatment, and finishing to produce the final product of increased volume.

2. Process according to claim 1, wherein the starting mixture contains exactly as much water as is required for increasing the volume by an exactly defined amount.

3. Process according to claim 1, comprising uniformly loading the starting mixture for carrying out the process continuously in a required amount with a defined layer thickness onto an endless transport means with side walls and free space above and between said side walls; and continuously irradiating the starting mixture on the endless transport means with the microwave radiation from a magnetron, whereby the increase in volume takes place into the free space.

4. Process according to claim 1, comprising uniformly loading the starting mixture for carrying out the process continuously in the required amount with a defined layer thickness onto a support with side walls, and with a free space above and between said side walls;

irradiating said starting mixture with microwave radiation; and removing the final product after terminating the radiation, whereby the increase in volume takes place into the free space.

5. Process according to claim 1, comprising removing from a treatment zone water vapor formed due to the introduction of heat;

condensing this water vapor to form liquid water; and recycling and reusing this liquid water for the preparation of the paper pulp.

6. Process according to claim 1, comprising using heat generated from magnetrons during energy conversion of microwave radiation and heat liberated by condensing of steam, for after-treatment process steps consuming thermal energy.

7. Process according to claim 1, wherein the frequency of the microwave radiation is in the range of 915 MHz and 2.45 GHz.

8. Process according to claim 1, comprising producing foamed material in the form of panels with a defined thickness.

9. Process according to claim 1, wherein the starting mixture contains an amount of water ranging between a minimum up to a maximum of from 5% to 75% by weight based upon the total weight of the starting mixture before the heating thereof.

10. Process according to claim 1, wherein the starting mixture contains an amount of water ranging between a minimum up to a maximum of from 10% to 65% by weight based upon the total weight of the starting mixture before the heating thereof.

11. Process according to claim 1, wherein the starting mixture contains an amount of water ranging between a minimum up to a maximum of from 15% to 50% by weight based upon the total weight of the starting mixture before the heating thereof.

* * * * *